US010617594B2

(12) United States Patent
Fujishiro et al.

(10) Patent No.: US 10,617,594 B2
(45) Date of Patent: Apr. 14, 2020

(54) AIR MASSAGE DEVICE

(71) Applicant: Fuji Medical Instruments Mfg. Co., Ltd., Osaka-shi, Osaka (JP)

(72) Inventors: Mitsuaki Fujishiro, Osaka (JP); Kentaro Ode, Osaka (JP)

(73) Assignee: FUJI MEDICAL INSTRUMENTS MFG. CO., LTD., Osaka (JP)

( * ) Notice: Subject to any disclaimer, the term of this patent is extended or adjusted under 35 U.S.C. 154(b) by 1065 days.

(21) Appl. No.: 15/009,728

(22) Filed: Jan. 28, 2016

(65) Prior Publication Data

US 2016/0317378 A1 Nov. 3, 2016

(30) Foreign Application Priority Data

May 1, 2015 (JP) ..... 2015-094359

(51) Int. Cl.
*A61H 9/00* (2006.01)
*A61H 15/00* (2006.01)

(52) U.S. Cl.
CPC ... *A61H 9/0078* (2013.01); *A61H 2015/0014* (2013.01); *A61H 2015/0042* (2013.01); *A61H 2201/0149* (2013.01); *A61H 2201/1207* (2013.01); *A61H 2201/1614* (2013.01); *A61H 2201/1623* (2013.01); *A61H 2201/1628* (2013.01); *A61H 2201/501* (2013.01); *A61H 2201/5002* (2013.01); *A61H 2201/5035* (2013.01); *A61H 2201/5087* (2013.01)

(58) Field of Classification Search
CPC ..... A61H 9/0078; A61H 2015/0042; A61H 2201/5002; A61H 2201/1628; A61H 2201/5087; A61H 2201/1207; A61H 2201/1623; A61H 2201/501; A61H 2015/0014
See application file for complete search history.

(56) References Cited

U.S. PATENT DOCUMENTS 3,866,604 A * 2/1975 Curless ..... A61H 9/0078 601/152
4,865,020 A * 9/1989 Bullard ..... A61H 9/0078 601/152

(Continued)

FOREIGN PATENT DOCUMENTS

CN 103313689 A 9/2013
JP 2001-054544 A 2/2001
JP 2001-149431 A 6/2001

OTHER PUBLICATIONS

JPO, Notice of Rejection dated Oct. 23, 2018 in JP Patent Application No. 2015-094359, total 6 Pages with English translation.

(Continued)

*Primary Examiner* — Tu A Vo
(74) *Attorney, Agent, or Firm* — Masuvalley & Partners

(57) ABSTRACT

Apparatus and method for providing massage with airbags which inflate by the supply of air and press against treatment regions of a human body. An air supply and exhaust device for supplying air to and exhausting air from the airbag is provided with an air pump, regulator, air tank, a solenoid valve, a diaphragm pump, a motor, an air supply speed adjustment valve and control unit for supplying air to the airbag such that the amount of air supplied to the airbag per unit time gradually increases.

6 Claims, 8 Drawing Sheets

(56) References Cited

U.S. PATENT DOCUMENTS 5,307,791 A * 5/1994 Senoue ..... A61H 9/0078 128/DIG. 20
5,607,447 A * 3/1997 McEwen ..... A61B 5/1106 606/202
6,210,345 B1 * 4/2001 Van Brunt ..... A61H 9/0078 600/529
6,231,532 B1 * 5/2001 Watson ..... A61H 9/0078 601/148
6,312,400 B1 * 11/2001 Itikawa ..... A61H 7/004 601/100
6,736,787 B1 * 5/2004 McEwen ..... A61H 9/0078 601/152
7,273,461 B2 * 9/2007 Baek ..... A61H 9/0078 601/134
2001/0004679 A1 * 6/2001 Ichikawa ..... A61H 7/001 601/98
2002/0099409 A1 * 7/2002 Hui ..... A61G 7/05776 606/201
2002/0190549 A1 * 12/2002 Chien-Chuan ..... A61H 9/0078 297/217.3
2004/0054306 A1 * 3/2004 Roth ..... A61H 9/0078 601/152
2005/0075531 A1 * 4/2005 Loeb ..... A61H 9/0078 600/17
2006/0004245 A1 * 1/2006 Pickett ..... A61H 9/0078 600/16
2006/0058717 A1 * 3/2006 Hui ..... A61H 9/0078 601/152
2006/0272097 A1 * 12/2006 Dionne ..... A61G 7/008 5/713
2007/0050910 A1 * 3/2007 Blanchard ..... A61H 9/0078 5/617
2007/0088239 A1 * 4/2007 Roth ..... A61H 9/0078 601/152
2007/0239087 A1 * 10/2007 Kivisto ..... A61H 9/0078 601/44
2010/0249679 A1 * 9/2010 Perry ..... A61H 9/0078 601/148
2014/0094726 A1 * 4/2014 Malhi ..... A61F 13/08 601/152
2014/0276253 A1 * 9/2014 Varga ..... A61F 7/02 601/15
2014/0276287 A1 * 9/2014 Pickett ..... A61H 9/0007 601/152
2014/0336552 A1 * 11/2014 Varga, Jr. ..... A61H 9/0007 601/149
2016/0175184 A1 * 6/2016 Arkans ..... A61H 9/0092 601/149

OTHER PUBLICATIONS

CN, Notice of Rejection dated Oct. 25, 2019 in CN Patent Application No. 201610051678.1, total 8 Pages with English translation.

* cited by examiner

1: chair type massage device
20: air supply and exhaust device
30 (30a~30k): airbags 1: chair type massage machine,
20: air supply and exhaust device,
21: air pump,
24: air supply speed adjustment means,
27: solenoid valve,
30 (30a ~ 30k): airbags,
50: control unit 24: Air Supply Speed Adjustment Means
50: Control Unit C2: Air Supply Cycle C3: Air Supply Cycle

AIR MASSAGE DEVICE

This application claims priority under 35 U.S.C. § 119 to Japanese patent application Serial No. 2015-094359, filed May 1, 2015 which is incorporated herein by reference in its entirety.

FIELD OF THE INVENTION

The present invention pertains to an air massage device, which presses against and massages treatment regions of a human body using an airbag inflated by air pressure.

BACKGROUND OF THE INVENTION

Conventionally, air massage devices are known which supply air to and exhaust air from an airbag through intermittent driving of an air supply and exhaust device to implement rubbing, pounding, and other types of massage motions to treatment regions of a human body.

In recent years, air massage machines which provide changes to the massage and are designed so as to be capable of providing a massage that approximates the motion of human hands have been proposed.

The air massage machine is provided with a controller for setting a massage pressure and/or a massage time for each of a plurality of airbags to desired values, and is configured so as to be capable of providing a massage which is similar to hand massaging by optionally setting the massage pressure and/or massage time for each of the plurality of airbags.

When attention is focused on each of the plurality of airbags provided for this type of air massage machine, it is clear that when an air pump is driven or the like to supply air to each of the airbags, air is supplied at a constant air supply amount per unit time (in other words, at a constant air supply speed) until the internal pressure (massage pressure) of the airbag reaches a prescribed pressure setting P1.

However, as with the air massage machine, even if air is supplied to the airbags at a constant air supply amount per unit time, the airbags are only able to obtain a prescribed pressing force, or a pressing force that increases at a certain rate of increase, and even if this type of airbag is pressed against the treatment regions of a person to be treated, the change in the manner that the airbag presses against the treatment regions is meager, and there is a concern that the massage could feel like monotonous mechanical pressing.

In other words, changes in pressing force with abundant degrees of strength as experienced with the massaging actions performed by human hands are not obtained, and there is a concern that such machines could bring about boredom with massages, and that a satisfying massage feeling cannot be obtained.

Therefore, further examination was necessary in order to enable users to experience a sense of massage that provides changes in degrees of strength that resemble those of a massage performed by human hands when treatment regions are pressed by air pressure.

SUMMARY OF THE INVENTION

The present embodiment is an air massage device including an airbag which is inflated by the supply of air and presses against treatment regions of a human body, and an air supply and exhaust device for supplying air to and exhausting air from the airbag; wherein the air supply and exhaust device is provided with an air supply means to supply air to the airbag such that the amount of air supplied per unit time (in other words, the air supply speed) to the airbag gradually increases.

DETAILED DESCRIPTION OF THE PREFERRED EMBODIMENTS

Embodiments of the present invention are described in detail below based on the drawings.

Figure 1:
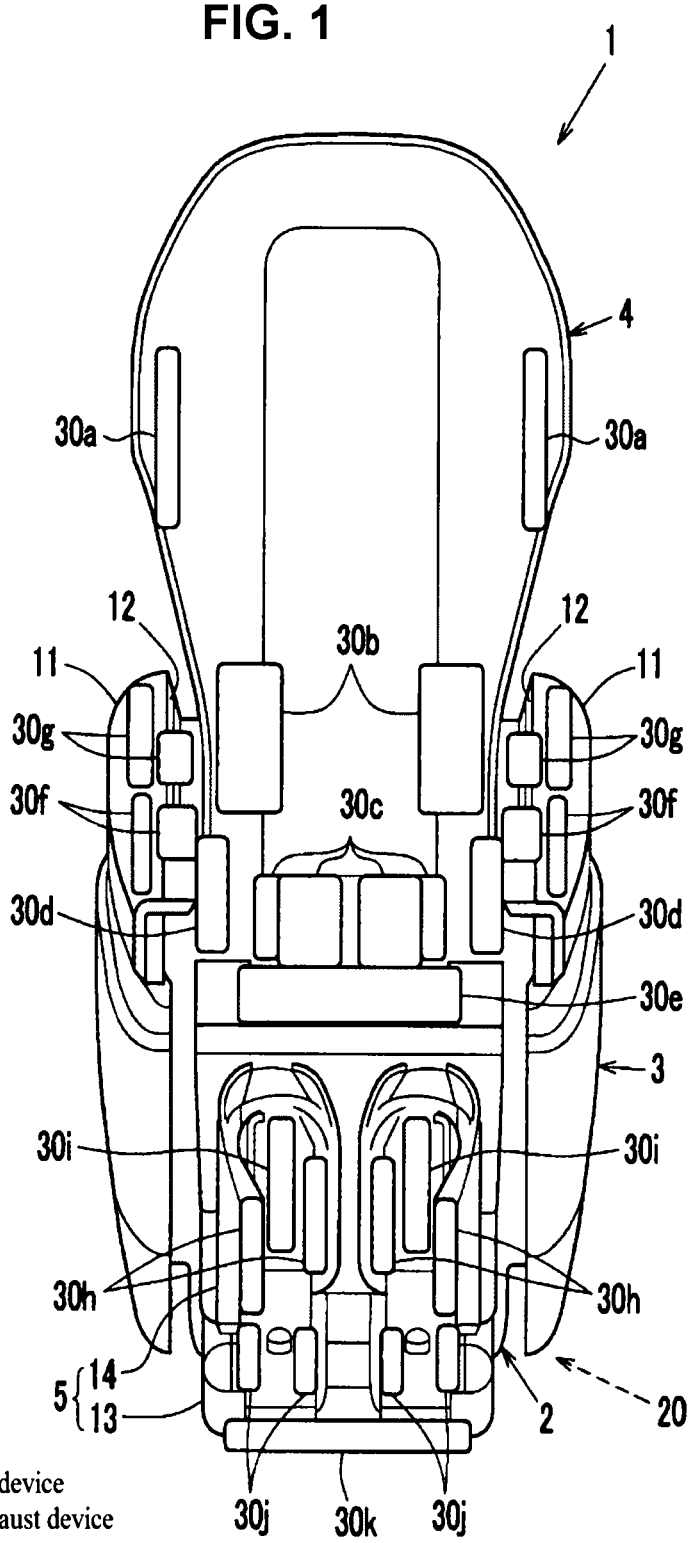
FIG. 1 is an elevation view of the chair type massage machine showing the arrangement locations of airbags.
Figure 2:
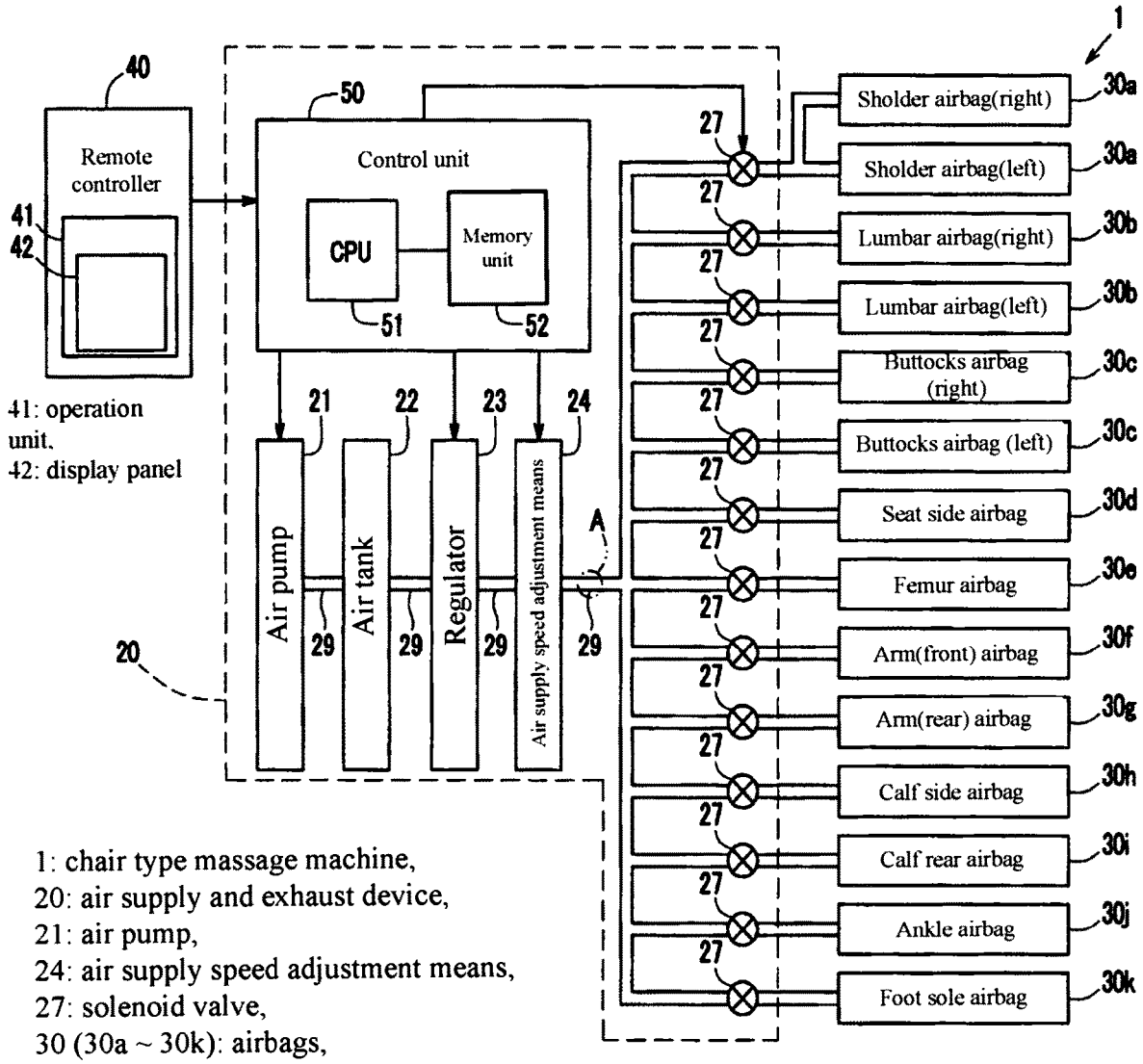
FIG. 2 is a block diagram showing an overview configuration of the chair type massage machine.

The drawings show a chair type massage machine 1 of the present invention. FIG. 1 is an elevation view schematically showing the chair type massage machine 1 of the present invention and showing the arrangement locations of the airbags, and FIG. 2 is a block diagram showing an overview configuration of the chair type massage machine 1 of the present embodiment. The chair type massage machine 1 of the present invention has a seat 3, on which a person to be treated sits, supported by a base 2 placed on a floor surface. A backrest 4 against which the back of the person to be treated is abutted is supported at a back end side of the seat 3, and a footrest 5 which accommodates the legs of the person to be treated is supported at a front end side of the seat 3.

An armrest 11 which can be tilted together with the seat 3 with respect to the base 2 is provided at both the right and the left sides of the seat 3. A forearm insertion concave part 12 in which the forearm part (part lower than the elbow) of the person to be treated, who has placed his or her elbows, can be inserted is provided at in armrest 11.

As shown in FIG. 1, the footrest 5 has a foot placement part 13 on which the foot of the person to be treated is placed, and a leg insertion concave part 14 in which the leg (lower leg part) is inserted.

While not illustrated, the chair type massage machine 1 is provided with a posture changing actuator 7, and a link mechanism made from a plurality of links which transmit the drive of the posture changing actuator 7 to each of the seat 3, the backrest 4 and the footrest 5 parts, and is configured such that the backrest 4 reclines backwards, and the footrest 5 projects forward by coordinating various elements and changing the reclining angle.

Airbags 30 (30*a* to 30*k*) are arranged as air type massage parts in each of the seat 3, the backrest 4, and the footrest 5 of the chair type massage machine 1.

More specifically, a shoulder airbag 30*a* corresponding to the shoulder area of the human body and a lumbar airbag

30*b* corresponding to the lumbar area are provided in the backrest 4. A buttocks airbag 30*c* corresponding to the buttocks area of the human body, a seat side airbag 30*d* corresponding to the lumbar side direction, and a femur airbag 30*e* corresponding to the femur area are arranged in the seat 3, and an arm front airbag 30*f* corresponding to the hands and an arm rear airbag 30*g* corresponding to the forearm part are arranged in the forearm insertion concave part 12 of the seat 3.

Furthermore, a calf side airbag 30*h* corresponding to the side of the calf, a calf rear airbag 30*i* corresponding to the rear of the calf, an ankle airbag 30*j* corresponding to the ankle, and a foot sole airbag 30*k* corresponding to the sole of the foot are arranged in the footrest 5.

Of the above-described airbags 30, the femur airbag 30*e* and the foot sole airbag 30*k* are wide airbags which straddle a center part in the width direction and are provided in a quantity of one each, the shoulder airbag 30*a*, the lumbar airbag 30*b*, the seat side airbag 30*d*, and the calf rear airbag 30*i* are provided symmetrically on the right and left sides with one of each on each side, and the buttocks airbag 30*c*, the arm front airbag 30*f*, the arm rear airbag 30*g*, the calf side airbag 30*h*, and the ankle airbag 30*j* are provided symmetrically on both the right and the left sides with two on each side. Of these, the arm front airbag 30*f*, the arm rear airbag 30*g*, the calf side airbag 30*h*, and the ankle airbag 30*j* are arranged respectively facing each other so as to sandwich the respectively corresponding body locations from both sides.

Note that in each of the seat 3, the backrest 4, and the footrest 5 of the chair type massage machine 1, in addition to the above-described airbags 30 that are used as air type massage parts, for example, mechanical massage parts such as vibration type parts, roller type parts, and rubbing ball type parts may be provided as appropriate, but the descriptions and illustrations thereof are omitted.

Air is supplied to and exhausted from the above-described airbags 30 by an air supply and exhaust device 20, thereby inflating and deflating the airbags.

As shown in FIG. 2, the air supply and exhaust device 20 is configured with an air pump 21, an air tank 22, a regulator 23, an air supply speed adjustment means 24, a solenoid valve 27, and a control unit 50.

The air pump 21 is a compressor, which generates compressed air, and an air tank 22 is connected via an air supply pipe 29 to a port which discharges the generated compressed air.

The air tank 22 absorbs the pulsation of compressed air supplied from the air pump 21, and thereby smooths out the compressed air, and has a function of separating foreign debris mixed into the air.

The regulator 23 is a device which is connected via the air supply pipe 29 to the air tank 22, and reduces the air pressure on the consumption side (airbag 30 side) with respect to the maximum air pressure of the compressed air from the air pump 21 to a desired constant pressure as necessary. In other words, the regulator 23 makes adjustments to an optional air supply amount such as 85% or 50% for example with respect to the maximum supply amount of air supplied from the air pump 21 based on a command from the control unit 50.

Figure 3:
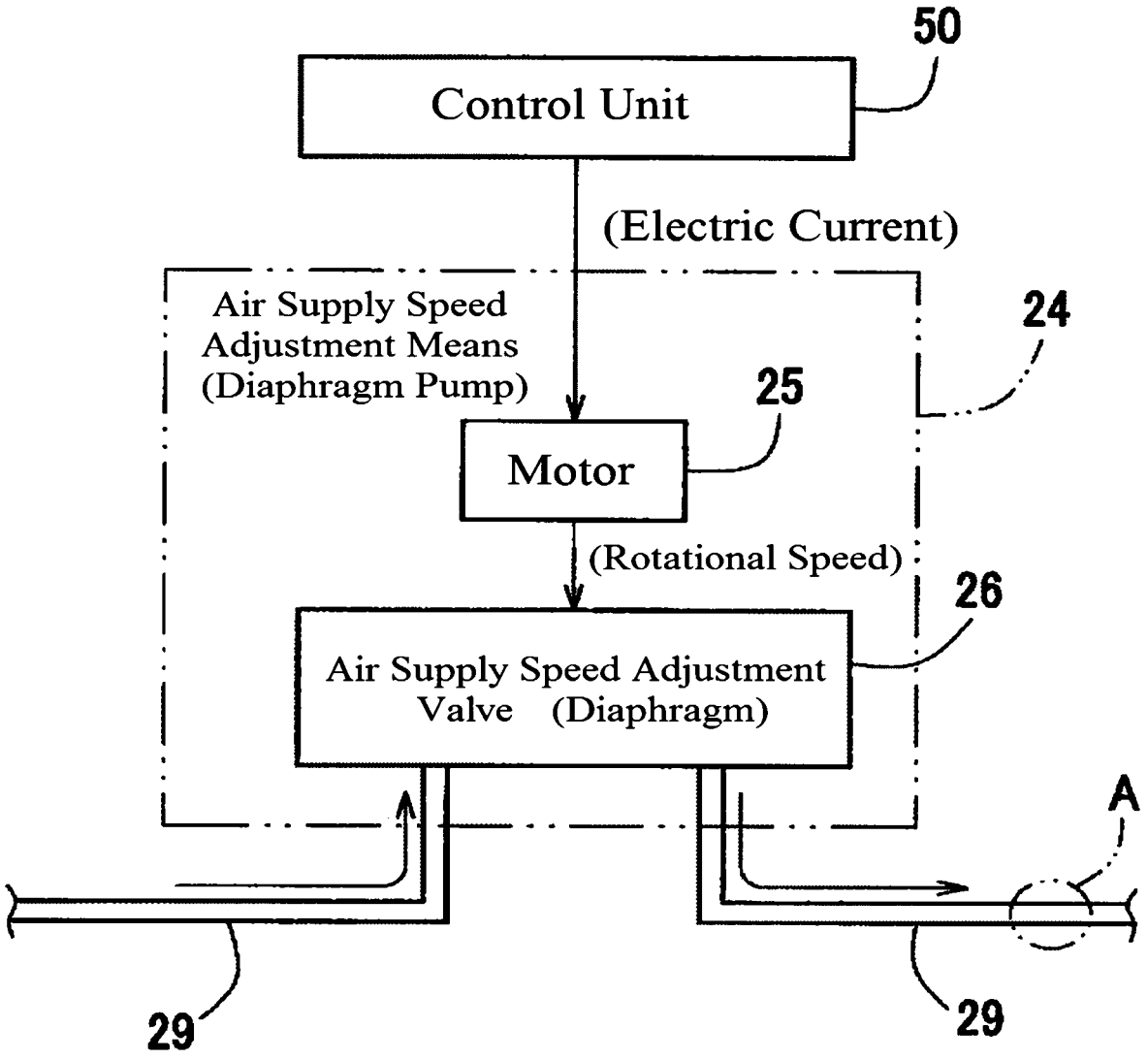
FIG. 3 is a block diagram showing an overview configuration of an air supply speed adjustment means provided with the chair type massage machine.

In the present embodiment, the air supply speed adjustment means 24 is configured of a diaphragm pump 24, and the diaphragm pump 24 is connected via the air supply pipe 29 to the regulator 23, is capable of adjusting the amount of air supplied per unit time (air supply speed) as the air supply amount to the airbag 30 side based on a command from the control unit 50, and is configured by a motor 25 and an air supply speed adjustment valve 26 like that shown in FIG. 3.

FIG. 3 is a block diagram showing an overview configuration of the air supply speed adjustment means 24 provided for an optional airbag 30 of the plurality of airbags 30 provided for the chair type massage machine 1.

The motor 25 is electrically connected to the control unit 50 and the air supply speed adjustment valve 26. In addition to switching between air supply and exhaust, the air supply speed adjustment valve 26 is capable of adjusting the air supply speed, and for example, can be configured with a diaphragm 26 (membrane) provided at the diaphragm pump 24.

With this type of air supply speed adjustment means 24, the rotational speed of the motor 25 is controlled by a command from the control unit 50, and the action speed of the diaphragm 26 when air suction and discharge are alternately performed inside the diaphragm pump 24 is thereby controlled. In other words, with the air supply speed adjustment means 24, the discharge amount per unit time from the diaphragm pump 24 (the air supply amount at point A in FIG. 2 and FIG. 3), or in other words, the amount of air supplied per unit time to the airbag 30 (air supply speed), can be controlled by a command from the control unit 50.

In this manner, the air supply speed adjustment means 24 is capable of controlling the air pressure of the airbags 30 such that the pressure increases with quadratic function characteristics by varying the amount of air supplied per unit time such that that amount of air that is supplied to the airbag 30 gradually increases at a constant rate of increase.

The solenoid valve 27 is excited by a command from the control unit 50, switches to an air supply position (ON), supplies air delivered from the pump to the airbag 30 with the air pump 21 and the airbag 30 in a state of communicating, and thereby inflates the airbag 30. When air is exhausted from an inflated airbag 30, the solenoid valve 27 is demagnetized by a command from the control unit 50, switches to the exhaust position (OFF), and causes the airbag 30 to communicate with the outside.

Note that with the chair type massage machine 1 of the present embodiment, as shown in FIG. 2, for the airbags 30 arranged at the right and the left sides, solenoid valves 27 are provided corresponding to each of the plurality of airbags 30 such as providing solenoid valves 27 individually at each of the left and the right sides, and by switching the solenoids individually between air supply or exhaust, each airbag 30 can be independently inflated or deflated. However, a common solenoid valve 27 is used for both the right and the left sides for the solenoid valve 27 corresponding to the shoulder airbag 30*a*.

The control unit 50 has a CPU 51 configured from a microprocessor and the like, and a memory unit 52 which stores various control programs, massage setting information, and the like in memory, and the control unit 50 is electrically connected to a remote control 40 (remote controller), the air pump 21, the regulator 23, the solenoid valve 27, and the air supply speed adjustment means 24. Furthermore, based on operations of the remote control 40, the control unit 50 at least controls the operation of the air pump 21, controls the amount of air supplied to the airbags 30 by reducing the pressure of the regulator 23, controls the amount of air supplied per unit time to the airbags 30 through the air supply speed adjustment means 24, and controls the switching of the solenoid valves 27 between supply and exhaust.

For example, when control to switch the solenoid valve 27 between supply and exhaust is performed by the control unit 50, of the plurality of airbags 30, control may be implemented to position a solenoid valve 27 corresponding to an optionally selected airbag 30 at the air supply position, and to select other solenoid valves 27 corresponding to airbags 30 to be discharged and to position those valves at the exhaust position, and in this manner, each of the plurality of solenoid valves 27 can be controlled to switch between air supply and exhaust.

Moreover, the above-described control of the amount of air supplied per unit time to the airbags 30 by the air supply speed adjustment means 24 is performed based on an air supply speed control circuit provided for the control unit 50, or based on an air supply speed control program stored in the memory unit 52, and as shown in FIG. 3, control of the air supply speed of the air supply speed adjustment valve 26 is performed by controlling the rotational speed of the motor 25 provided in the air supply speed adjustment means 24 by controlling the electric current value as a control amount.

The remote control 40 is arranged at one of the armrests 11 of the chair type massage machine 1 (not illustrated), and as shown in FIG. 2, is provided with an operation unit 41 for optionally setting and regulating the orientation (angle, position) of the backrest 4 and the footrest 5 and/or the action state, position, strength (air pressure), and operation time of the massage parts, and with a touch panel type display panel 42 for digitally displaying the states thereof. A selection screen or the like for touching and selecting various automatic courses can be displayed in the display panel 42.

Note that an automatic course is an automatic course specialized in massages particularly using the airbags 30 and for which massage patterns which use mechanical massage parts and/or a plurality of air type massage parts are chronologically combined, and sequence control is performed by the control unit 50 based on various timing charts for a plurality of treatment areas. In the present embodiment, a "pelvis massage action" mode, a "seat side+lumbar area massage action" mode, and a "seat side+buttocks massage action" mode are provided and can be selected from the display panel 42, and the "pelvis massage action" mode is prepared with two patterns.

Figure 4:
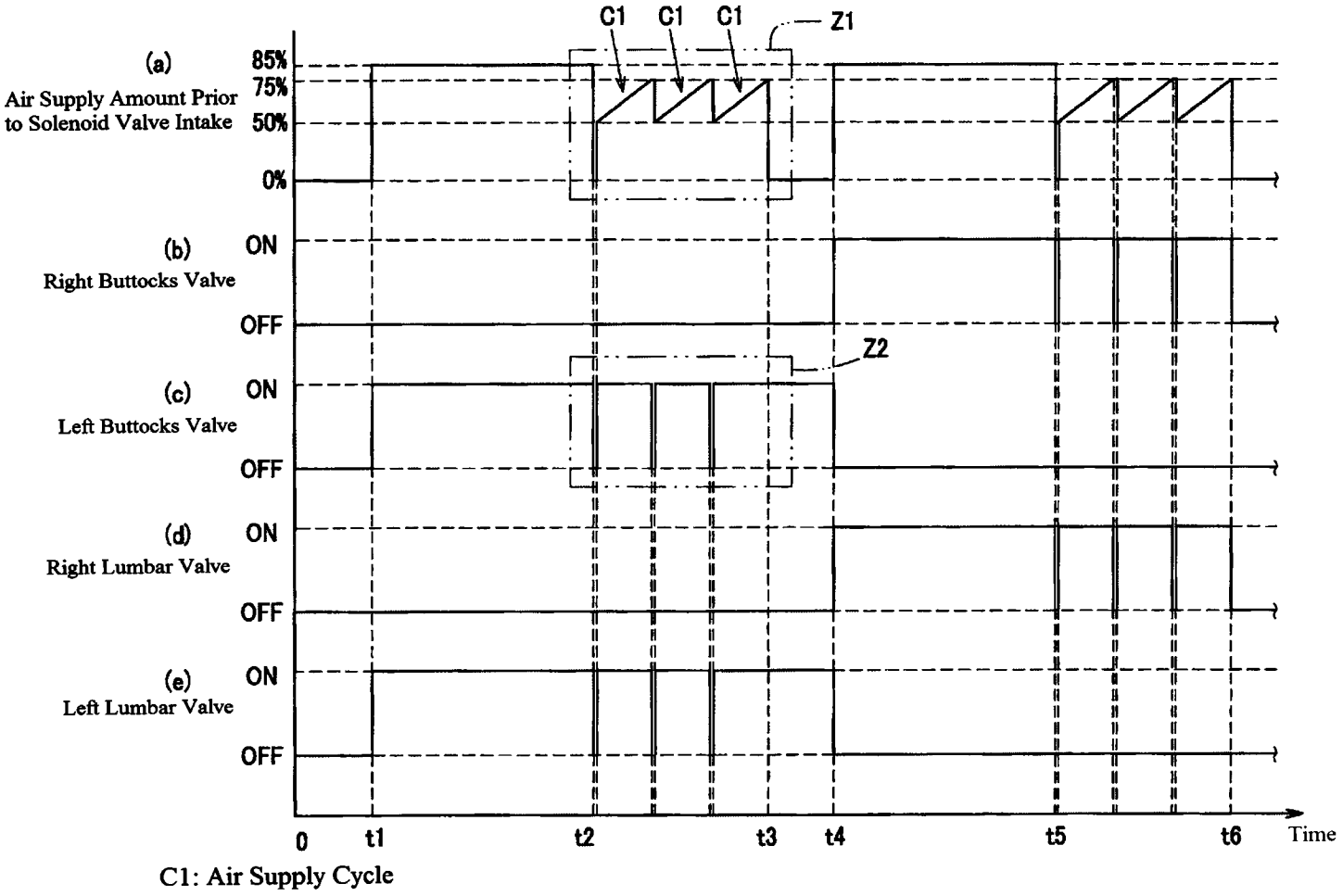
FIG. 4 is a timing chart showing the air supply amount of the air pump and the switching of the solenoid valve with regard to an automatic course of the present embodiment.

An embodiment of a first pattern of the "pelvis massage action" mode is described as an automatic course of the chair type massage machine 1 of the above-described configuration with reference to the timing charts shown in FIGS. 4(*a*), (*b*), (*c*), (*d*), and (*e*).

Note that FIG. 4(*a*) is a timing chart showing the change in the air supply amount prior to air intake by the solenoid valve 27 in the "pelvis massage action" mode (in other words, the discharge amount per unit time from the air supply speed adjustment valve 26), and FIGS. 4(*b*), (*c*), (*d*), and (*e*) are timing charts respectively showing the switching between air supply and exhaust of each solenoid valve 27 for the right buttocks, the left buttocks, the right lumbar area, and the left lumbar area in the "pelvis massage action" mode.

The "pelvis massage action" mode is a mode which repeats a pelvis massage operation at a prescribed time to cause the buttocks (left) airbag 30*c* and the lumbar (left) airbag 30*b* to operate as a pair and the buttocks (right) airbag 30*c* and the lumbar (right) airbag 30*b* to operate as a pair with operation alternating between the right and the left pairs based on sequence control by the control unit 50.

More specifically, for the buttocks (left) airbag 30*c* and the lumbar (left) airbag 30*b*, the control unit 50 implements sequence control for which it first waits until a time of t1 (s) after startup, after which at the t1 (s) to t2 (s) interval, air is supplied continuously to the airbag 30 for 10 s at a constant air supply amount of 85% of the maximum air supply amount of the air pump 21, and then in the t2 (s) to t3 (s) interval, an air supply cycle C1, which gradually increases the amount of air supplied per unit time to 75% of the maximum air supply amount of the air pump 21 from a level of 50% thereof, is repeated three times, after which in the t3 (s) to t4 (s) interval, the air pressure is maintained at a constant level.

Next, at the t4 (s) to t6 (s) interval, the control unit 50 implements the same above-described sequence control that it implemented for the buttocks (left) airbag 30*c* and the lumbar (left) airbag 30*b*, but this time it is implemented for the buttocks (right) airbag 30*c* and the lumbar (right) airbag 30*b*, and from that point forward, this type of pelvis massage action is repeated for a prescribed amount of time while alternating between the right and the left sides.

Figure 5:
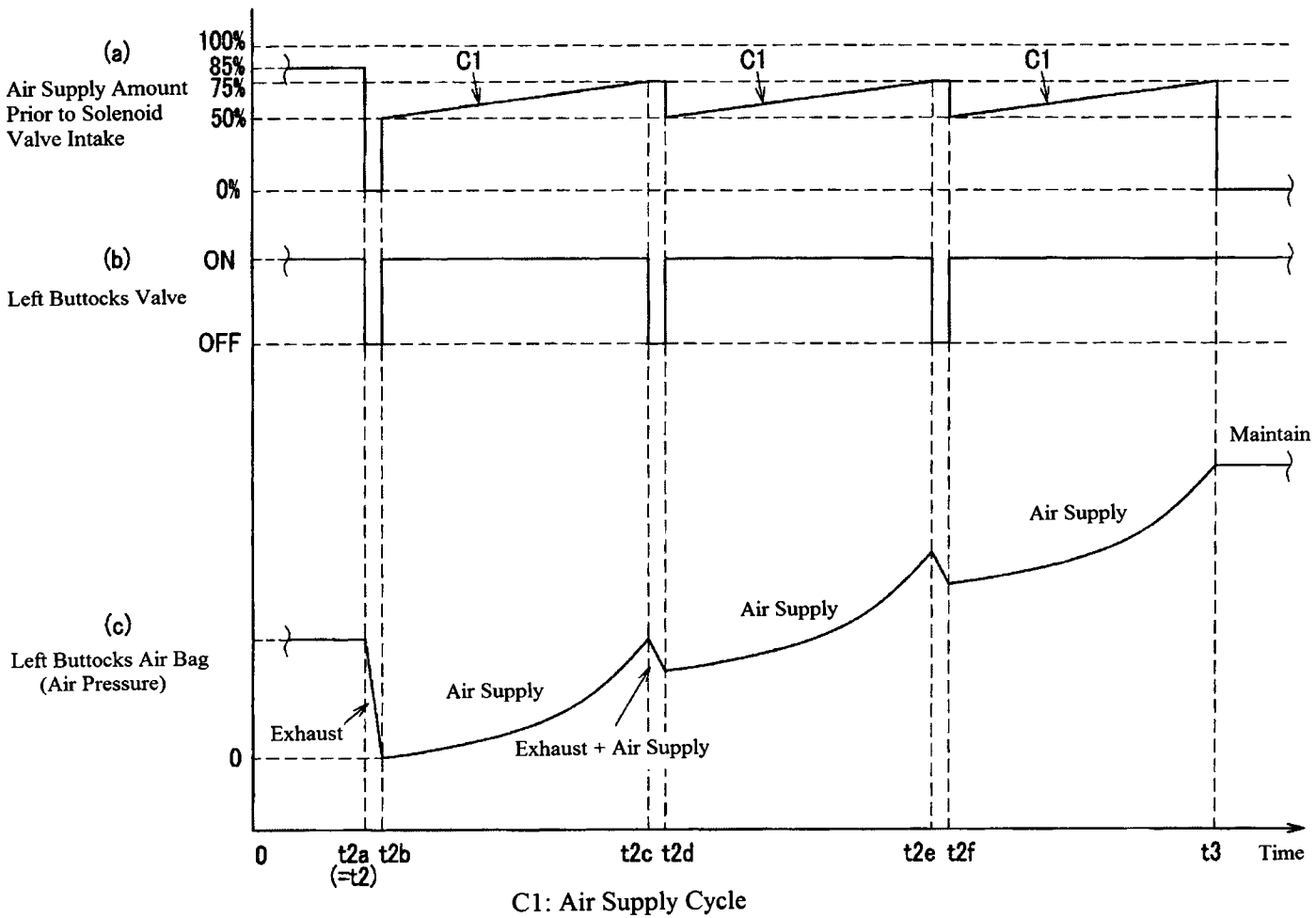
FIG. 5 is a timing charge showing the air pressure of an airbag in the automatic course of the present embodiment.

Here, a timing chart which includes the air supply cycle C1 for the above-described t2 (s) to t3 (s) interval is described with attention focused on the buttocks (left) airbag 30*c* and with reference with FIG. 5.

Note that FIG. 5(*a*) is an expanded view of the area Z1 in FIG. 4(*a*) and is a timing chart showing the change in the air supply amount prior to air intake into the solenoid valve 27 corresponding to the buttocks (left) airbag 30*c* (left buttocks solenoid valve 27) in the t2 (s) to t3 (s) interval, FIG. 5(*b*) is an expanded view of the area Z2 in FIG. 4(*b*), and is a timing chart showing the action of the left buttocks solenoid valve 27 of switching between air intake and exhaust in the t2 (s) to t3 (s) interval, and FIG. 5(*c*) is a timing chart showing the change in the air pressure of the left buttocks airbag 30C in the t2 (s) to t3 (s) interval.

Next, the air supply cycle C1, which is repeated three times in the t2 (s) to t3 (s), interval is described in detail. As shown in FIG. 5(*a*), first, the control unit 50 controls the air pump 21 and the regulator 23 such that at the point in time of t2 b(s), the amount of air supplied per unit time prior to the solenoid valve 27 air intake, or in other words, the discharge amount per unit time from the air supply speed adjustment valve 26 (the air supply amount at point A in FIG. 2 and FIG. 3) is suddenly increased from 0% of the maximum air supply amount of the air pump 21 to 50% thereof, and as shown in FIG. 5(*b*), the left buttocks solenoid valve 27 is switched to the air supply position (ON).

Next, during a 2.5 s period in the t2 b(s) to t2 c(s) interval, the control unit 50 performs the air supply cycle C1, which gradually increases the amount of air supplied per unit time prior to air intake of the solenoid valve 27 such that the amount of air supplied thereof increases from 50% of the maximum air supply amount of the air pump 21 to a level of 75% thereof, by controlling the air supply speed adjustment means 24.

If attention is focused on the air pressure of the buttocks (left) airbag 30*c* in this t2 b(s) to t2 c(s) interval, the buttocks (left) airbag 30*c* has an air pressure of 0 at the t2 b point in time (see FIG. 5(*c*)), but because the left buttocks solenoid valve 27 is switched to the air supply position in this interval (see FIG. 5(*b*)), the amount of air supplied to the buttocks (left) airbag 30*c* increases.

In particular, with the present embodiment, as described above, because air is gradually supplied to the buttocks (left) airbag 30*c* in this t2 b(s) to t2 c(s) interval such that the amount of air supplied per unit time, prior to intake of the solenoid valve 27, increases from 50% of the maximum air supply amount of the air pump 21 to 75% thereof, as shown in FIG. 5(*c*), the air pressure of the buttocks (left) airbag 30*c* tends to exhibit a quadratic function characteristic for which the air pressure is weak during the initial rise period, and with the passage of time, it increases while the rate of increase also increases.

The buttocks (left) airbag 30*c* performs a pelvis massage action while pressing against the pelvis of the person to be treated based on this type of air-based inflation characteristic, and as a result, when massaging is started, the massage is slowly performed, and as the massaging conditions advance, the pressing strength increases stepwise (slowly but steadily), a high air pressure is exhibited until right before the massaging action ends, and the pelvis can be firmly massaged.

Therefore, the person to be treated can experience a massage feeling that approximates the massaging action performed by human hands.

Furthermore, during a period of 0.15 s in the t2 c(s) to t2 d(s) interval, the left buttocks solenoid valve 27 is switched to the exhaust position (OFF), and as a result, the air pressure of the buttocks (left) airbag 30*c* instantaneously decreases (see FIG. 5(*c*)), but the second air supply cycle C1 begins from t2 d(s), and sequence control that is the same as the above-described first air supply cycle C1 is performed, and therefore in the t2 e(s) to t2 d(s) interval, once the air pressure has dropped, before the air is completely removed from the deflated buttocks (left) airbag 30*c*, air is once again supplied to the airbag thereof such that the air pressure gradually increases, and the airbag 30*c* is inflated (see FIG. 5(*c*)).

In the t2 (s) to t3 (s) interval, the control unit 50 repeats this type of air supply cycle C1 three times, but each time the air supply cycle C1 ends, the left buttocks solenoid valve 27 is instantaneously switched to the exhaust position, the air pressure immediately decreases, and before the air is completely removed, once again, the left buttocks solenoid valve 27 is switched to the air supply position, and sequence control to perform the next air supply cycle C1 is performed.

In this manner, through the air supply cycle C1, the buttocks (left) airbag 30*c* gradually increases the massaging condition, after which the massaging condition is instantaneously weakened, and then through the next air supply cycle C1, a massaging action with a stronger massaging condition than that of the previous air supply cycle C1 can be repeated.

Therefore, the person to be treated can more fully experience a massage feeling that approximates the massage action obtained through human hands with abundant degrees of strength.

Next, timing charts which use other automatic courses and include air supply cycles of C2, C3, and C4 of other embodiments are described.

However, explanations of details which are the same as those of the first pattern of the above-described "pelvis massage action" mode are omitted.

Figure 6:
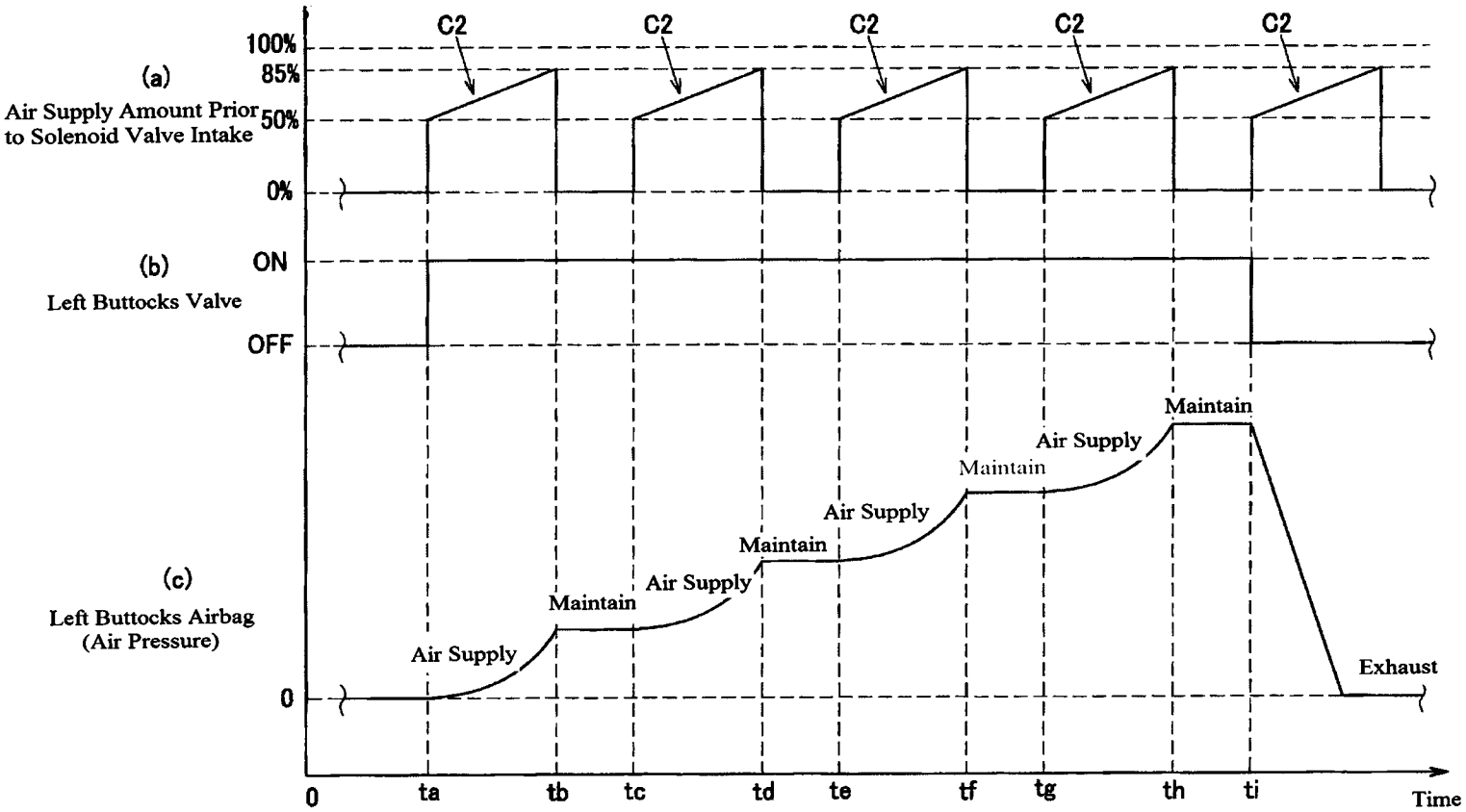
FIG. 6 is a timing charge showing the air pressure of an airbag in the automatic course of another embodiment.

FIGS. 6(*a*), (*b*), and (*c*) are timing charts which focus attention on the buttocks (left) airbag 30*c* and were extracted for a prescribed ta(s) to ti(s) interval that includes the air supply cycle C2 of the present embodiment from the timing chart (not illustrated) of the above-described "pelvis massage action" mode of a second pattern as an irregular pattern of the "pelvis massage action" mode. Each is a timing chart which corresponds to FIGS. 5(*a*), (*b*), and (*c*) described above for the air supply cycle C1 of the "pelvis massage action" mode.

The prescribed ta(s) to ti(s) interval of the second pattern of the "pelvis massage action" mode is described next in detail. First, during a 5 second period of ta(s) to tb(s), the control unit 50 switches the left buttocks solenoid valve 27 to the air supply position (see FIG. 6(*b*)), and performs the air supply cycle C2 to gradually supply air such that the amount of air supplied per unit time prior to the intake of the solenoid valve 27 gradually increases to 85% of the maximum air supply amount of the air pump 21 from a level of 50% thereof (see FIG. 6(*a*)).

Through this air supply cycle C2, the buttocks (left) airbag 30*c* can be inflated while increasing the air pressure with quadratic function characteristics from a state of 0 (see FIG. 6(*c*)). Next, for a period of 3 seconds in the tb(s) to tc (c) interval, the control unit 50 maintains the buttocks (left) airbag 30*c* at the air pressure that was increased by the air supply cycle C2. Note that this tb(s) to tc(s) interval is an air pressure maintenance cycle.

In the prescribed interval of ta(s) to tj(s), the control unit 50 alternately repeats this type of air supply cycle C2 and air pressure maintenance cycle four times, after which at the point in time of ti(s), the control unit 50 switches the left buttocks solenoid valve 27 to the exhaust position (see FIG. 6(*b*)) to thereby deflate the buttocks (left) airbag 30*c*.

With the second pattern of the "pelvis massage action", according to the adopted sequence control, in addition to the above-described effect of the air pressure of the buttocks (left) airbag 30*c* increasing through the above-described air supply while exhibiting quadratic function characteristics with the passage of time, the air pressure maintenance cycle is performed each time the air supply cycle C2 is performed, and as a result, the air pressure after the air supply cycle C2 is maintained, and the next air supply cycle C2 can be performed.

Accordingly, with each air supply cycle C2, the condition of the massaging action can be more fully strengthened stepwise, and the person to be treated can experience a massage feeling that approximates the massaging action achieved by human hands.

Figure 7:
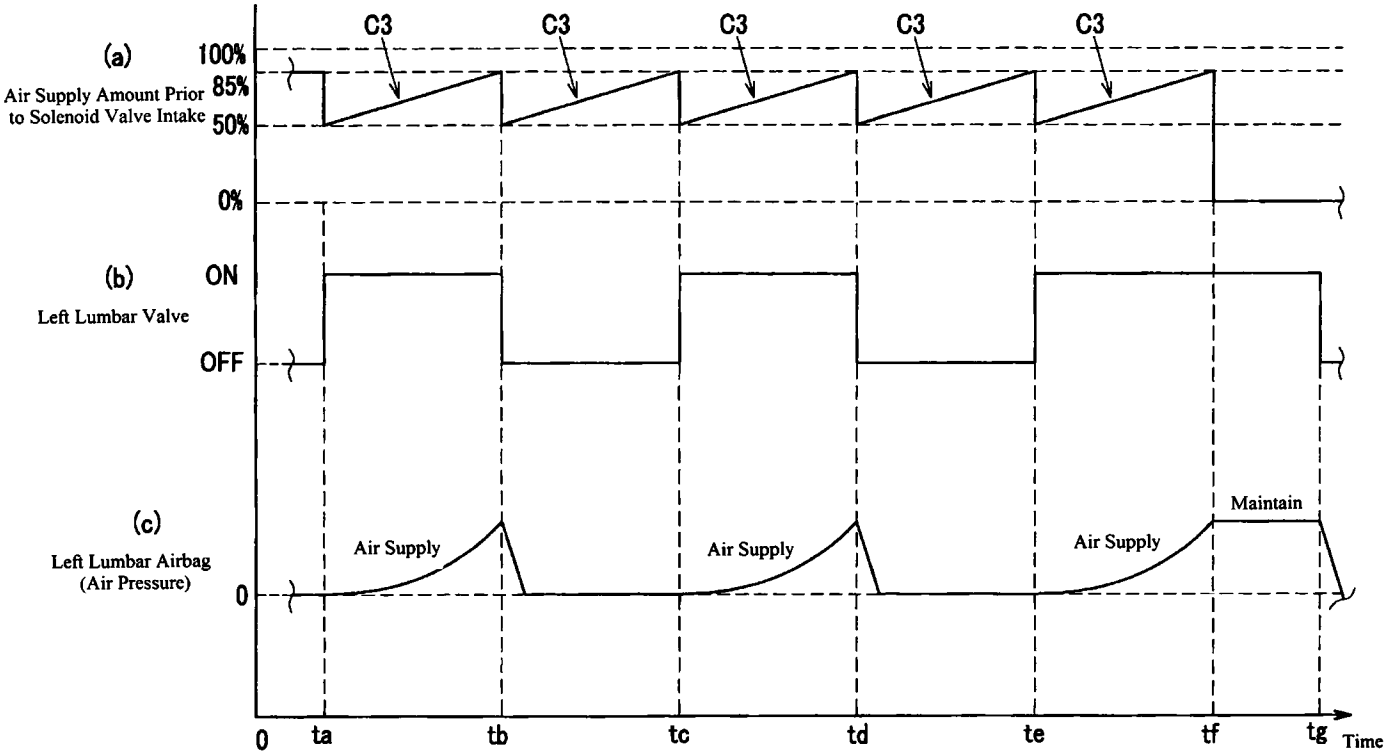
FIG. 7 is a timing charge showing the air pressure of an airbag in the automatic course of another embodiment.

FIGS. 7(*a*), (*b*), and (*c*) are timing charts which focus attention on the lumbar (left) airbag 30*b* and were extracted for a prescribed interval of ta(s) to tg(s) that includes an air supply cycle C3 of the present invention from the timing chart (not illustrated) for the "seat side+lumbar massage action" mode which combines and performs inflating and deflating action through the seat side airbag 30*d*, the lumbar (left) airbag 30*b*, and the lumbar (right) airbag 30*b*. In addition, each is a timing chart which corresponds to FIGS. 5(*a*), (*b*), and (*c*) described above for the air supply cycle C1 of the "pelvis massage action" mode.

The prescribed ta(s) to tg(s) interval of the second pattern of the "seat side+lumbar massage action" mode is described next in detail. First, during a period measured in seconds of ta(s) to tb(s), the control unit 50 switches the left lumbar solenoid valve 27 to the air supply position (see FIG. 7(*b*)), and performs the air supply cycle C3 to gradually supply air such that the amount of air supplied per unit time prior to the intake of the solenoid valve 27 gradually increases to 85% of the maximum air supply amount of the air pump 21 from a level of 50% thereof (see FIG. 7(*a*)).

Through this air supply cycle C3, the lumbar (left) airbag 30*b* can be inflated while increasing the air pressure with quadratic function characteristics from a state of 0 (see FIG. 7(*c*)).

In the prescribed interval of ta(s) to tf(s), the control unit 50 repeats this type of air supply cycle C3 five times, but in the second air supply cycle C3 (tb(s) to tc(s)) and the fourth air supply cycle C3 (td(s) to te(s)), the lumbar solenoid valve 27 is switched to the exhaust position (see FIG. 7(*b*)), and therefore in this tb(s) to tc(s) interval and td(s) to te(s)

interval, the lumbar (left) airbag 30*b* deflates. Here, the tb(s) to tc(s) interval and the td(s) to te(s) interval are exhaust cycles.

Moreover, in the prescribed interval from ta(s) up to tf(s), the control unit 50, repeats this type of air supply cycle C3 five times, after which it maintains the lumbar solenoid valve 27 at the air supply position for a period of 3 seconds in the tf(s) to tg(s) interval as well (see FIG. 7(*b*)), and therefore the air pressure of the lumbar (left) airbag 30*b* is maintained (see FIG. 7(*c*)).

In this manner, according to the sequence control adopted in the "seat side+lumbar massage action" mode, in addition to the above-described effect of the air pressure of the lumbar (left) airbag 30*b* increasing through gradual air supply while exhibiting quadratic function characteristics with the passage of time, by repeating the above-described air supply cycle C3 and exhaust cycle, a firm massaging condition is exhibited through air pressure that is increased with quadratic function characteristics in the air supply cycle C3, and in the exhaust cycle that follows, the air is then suddenly released, and as a result, a massage action with abundant degrees of strength, which is characteristic of the present embodiment that fully utilizes the matter of performing the air supply cycle C3, can be realized.

FIGS. 8A, 8B, and 8C are timing charts which focus attention on the buttocks (right) airbag 30*c* and were extracted for a prescribed ta(s) to tg(s) interval that includes the air supply cycle C4 of the present embodiment from the timing chart (not illustrated) of the "seat side+buttocks massage action" mode which combines and implements inflation and deflation action through the seat side airbag 30*d*, the buttocks (right) airbag 30*c*, and the buttocks (left) airbag 30*d*. Each is a timing chart which corresponds to FIGS. 5(*a*), (*b*), and (*c*) described above for the air supply cycle C1 of the "pelvis massage action" mode.

The prescribed ta(s) to tg(s) interval of the "seat side+buttocks massage action" mode is described next in detail. Similar to the above-described air supply cycle C3 of the "seat side+lumbar massage action" mode (see FIG. 7), during the ta(s) to tf(s) interval, the control unit 50 repeats five times the air supply cycle C4 (see FIG. 8(*a*)), which gradually increases the amount of air supplied per unit time prior to the intake of the solenoid valve 27 to 85% of the maximum air supply amount of the air pump 21 from a level of 50% thereof, and then next, maintains the right buttocks solenoid valve 27 at the air supply position for a 3 second period in the tf(s) to tg(s) interval (see FIG. 8(*b*)), and in this tf(s) to tg(s) interval as well, the air pressure of the buttocks (right) airbag 30*c* is maintained (see FIG. 8(*c*)).

Figure 8:
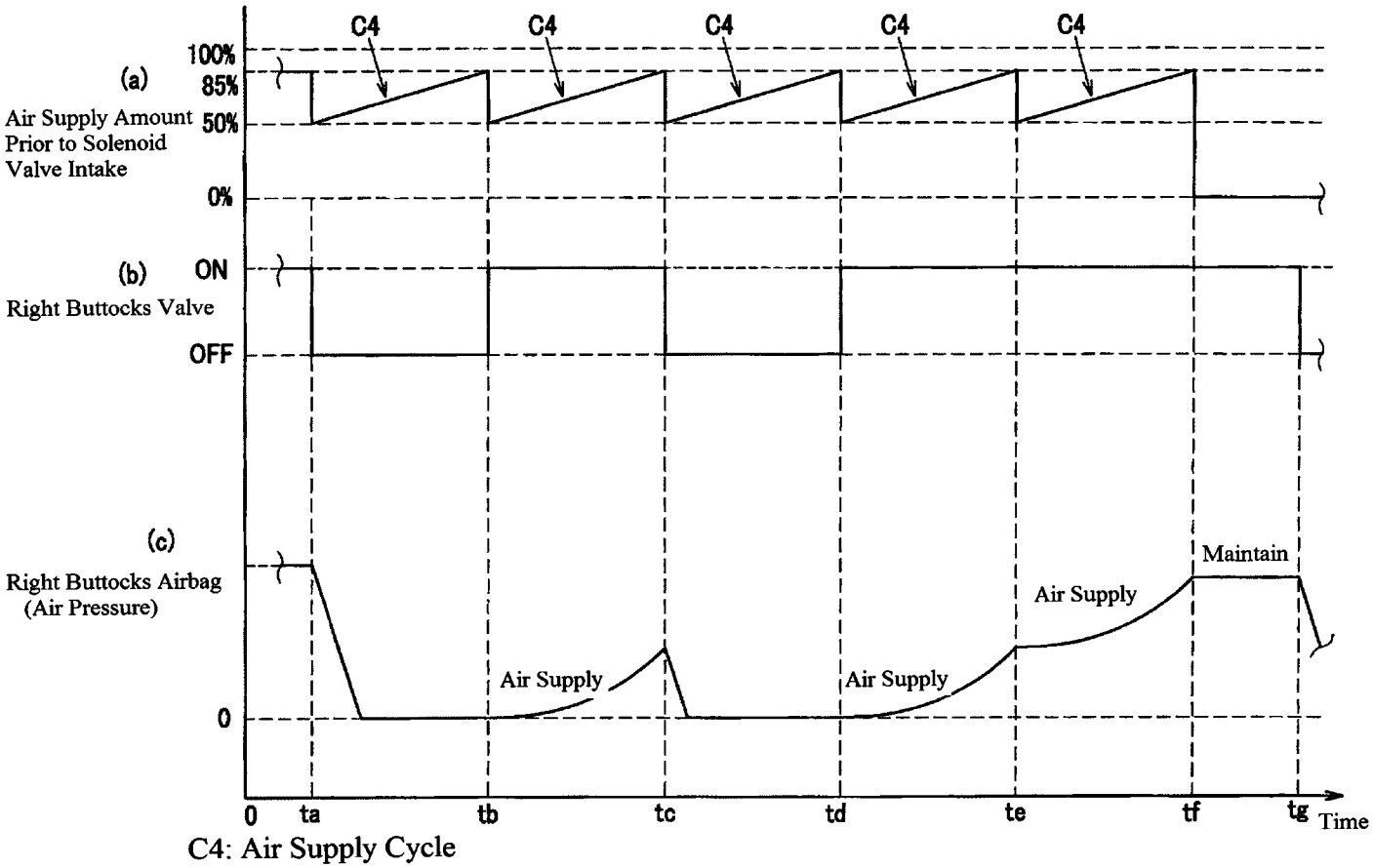
FIG. 8 is a timing charge showing the air pressure of an airbag in the automatic course of another embodiment.

In the ta(s) to tf(s) interval, the control unit 50 repeats this type of air supply cycle C4 five times, but in the first air supply cycle C4 (ta(s) to tb(s)) and the third gradual air supply interval (tc(s) to td(s)), the control unit 50 switches the right buttocks solenoid valve 27 to the exhaust position (see FIG. 8(*b*)), and therefore in this ta(s) to tb(s) interval and in this tc(s) to td(s) interval, the buttocks (right) airbag 30*c* deflates (see FIG. 8(*c*)). Here, the ta(s) to tb(s) interval and the tc(s) to td(s) interval are exhaust cycles.

On the other hand, in the fourth air supply cycle C4 (td(s) to te(s)) and the fifth air supply cycle C4 (te(s) to tf(s)), the control unit 50 performs control to maintain the right buttocks solenoid valve 27 continuously switched to the air supply position (see FIG. 8(*b*)), and therefore this td(s) to te(s) interval and this te(s) to tf(s) interval become continuous air supply cycles C4 that inflate the buttocks (right) airbag 30*c* (see FIG. 8(*c*)).

In this manner, according to the sequence control adopted in the "seat side+buttocks massage action" mode, in addition to the above-described effect of the air pressure of the buttocks (right) airbag 30*c* increasing through gradual air supply while exhibiting quadratic function characteristics with the passage of time, a buttocks massage action that includes a mixture of the repetition of the air supply cycle C4 and the exhaust cycle and the continuous repetition of the air supply cycle C4 can be realized, and a massage action with abundant degrees of strength, which is characteristic of the present embodiment that fully utilizes the air supply cycle C4, can be realized.

According to the above-described chair type massage machine 1, a chair type massage machine is provided with airbags 30 which inflate through the supply of air and press against treatment locations of the human body, and an air supply and exhaust device which supplies air to and exhausts air from the airbags 30, wherein the air supply and exhaust device 20 is provided with an air pump 21, an air supply speed adjustment means 24, and a control unit 50 as an air supply means for supplying air to the airbags 30 such that the amount of air supplied to the airbags 30 per unit time gradually increases (see FIG. 2 and FIG. 3).

According to the above-described configuration, by controlling the amount of air supplied per unit time through the above-described air supply speed adjustment means 24, the control unit 50 of the present embodiment is capable of causing air to be supplied to the airbags 30 such that the air supply amount gradually increases, and is capable of increasing the air pressure with quadratic function characteristics.

Through this, when a massage is performed while pressing against treatment regions of the human body, unlike the monotonous mechanical pressing like that which occurs when the pressing force in increased at a constant rate, the treatment regions can be pressed while changing the strength of the pressing force (the rate of increase of the pressing force) such that when pressing of treatment regions first begins, the pressing is done slowly (slowly but steadily), and as pressing continues, the pressing force strengthens, and as a result, a massage feeling that approximates the feeling achieved with the motion of human hands can be obtained.

An aspect of the present invention is configured with the air pump 21, the air supply speed adjustment means 24, and the control unit 50 such that the amount of air supplied per unit time can be continuously increased (see each of the air supply cycles C1, C2, C3, and C4 shown in FIG. 4 to FIG. 8).

According to the above-described configuration, because the amount of air supplied per unit time does not increase in steps (non-continuously), sudden changes in the pressing force can be suppressed, and the pressing force can be increased gradually. Therefore, a massage feeling that approximates the action of human hands through firm pressing can be obtained, and a comfortable massage feeling can be obtained without sudden pressing.

Moreover, as an aspect of the present invention, the air pump 21, the air supply speed adjustment means 24, and the control unit 50 repeat air supply cycles C1, C2, C3, and C4, which gradually increase the amount of air supplied from when the increase in the amount of air supplied per unit time begins until the amount thereof decreases (see FIG. 4 to FIG. 8).

According to the above-described configuration, massage action which cyclically repeats degrees of pressing strength such as rubbing and pounding can be performed, and the area to be treated can be pressed while varying the condition of the pressing strength with each of these cycles, and therefore a massage feeling that approximates the actions of rubbing and/or pounding through human hands can be obtained.

Moreover, as an aspect of the present invention, the air supply and exhaust device 20 is provided with an air pump 21 which supplies air to the airbag 30, and with a solenoid valve 27 arranged between the air pump 21 and the airbag 30, and the air supply and exhaust device 20 repeats the air supply cycle C2 with the solenoid valve 27 in a closed state (see FIG. 6).

According to the above-described configuration, the condition of the pressing strength (rate of increase of the pressing force) can be varied with each of the plurality of air supply cycles C2 of this type, and the pressing force can be increased stepwise each time the plurality of air supply cycles C2 is repeated, and therefore sufficient pressing force which approximates the motion of human hands but which is difficult to achieve with human hands can be exhibited, and further improvements in the massage feeling can be achieved.

The air massage device of the present invention corresponds to the chair type massage machine 1 of the above-described embodiment, and similarly, hereinafter, the air supply means corresponds to the air pump 21, the air supply speed adjustment means 24, and the control unit 50, and the valve corresponds to the solenoid valve 27, but the present invention is not limited to only the configurations of the above-described embodiments.

For example, in the present embodiment, the air supply speed adjustment means 24 was configured with a diaphragm pump 24, but it may be configured of another means as long as it is a configuration that is capable of making adjustments such that the amount of air supplied to the airbag 30 per unit time gradually increases.

Moreover, the air supply means provided for the air massage device of the present invention is not limited to a configuration provided with an air supply speed adjustment means 24 further to the consumption side (airbag 30 side) than the air pump 21, and for example, as the air pump 21, a piston pump may be adopted, and a configuration for which the air supply speed adjustment means, which gradually increases the amount of air supplied to the airbag 30 per unit time, is built into the air pump 21 may be adopted.

Moreover, in the above-described embodiment, the control unit 50 controls the rotational speed of the motor 25 provided for the air supply speed adjustment means 24 by controlling the electric current value as a control amount, and as a result, the control unit 50 controls the air supply speed of the air supply speed adjustment valve 26. However, the present invention is not limited to the use of electric current as a control amount in this manner, and a voltage value and/or pulses, or other such control amount may be adopted, and the control amount for controlling the motor 25 is not limited to rotational speed, and another control amount such as an angle of rotation, torque, speed, or acceleration may be adopted.

Furthermore, the present invention is not limited to adopting an adjustable configuration that gradually increases the amount of air supplied per unit time for all of the plurality of airbags 30 (30*a* to 30*k*) provided in the chair type massage machine 1 as in the present embodiment, and such configuration can be adopted for at least any one of the airbags 30.

It should be noted that when a massage is performed while pressing against treatment regions of a human body according to one embodiment, unlike the monotonous mechanical pressing like that which occurs when the pressing force in increased at a constant rate, the treatment regions can be pressed while changing the strength of the pressing force (the rate of increase of the pressing force) such that when pressing of treatment regions first begins, the pressing is done slowly (slowly but steadily), and as pressing continues, the pressing force strengthens, and as a result, a massage feeling that approximates the feeling achieved with the motion of human hands can be obtained.

Here, the air supply means can be configured such that the amount of air supplied per unit time of a diaphragm pump or the like can be adjusted by at least any of a pump, valve, and a control means which controls these.

As an aspect of the present invention, the air supply means is configured such that the amount of air supplied per unit time continuously increases.

According to the abovementioned configuration, the amount of air supplied per unit time does not increase in a stepwise manner (non-continuous manner), and therefore sudden changes in the pressing force can be suppressed, and the pressing force can be gradually increased. Accordingly, a massage feeling that approximates the feeling obtained by the action of human hands by firmly pressing against the treatment area can be obtained, and a comfortable massage feeling can be obtained without any sudden pressing against the treatment area.

Here, the abovementioned "continuously increased" means an increase that excludes an increase in a stepped manner, and for example, includes an increase with a linear characteristic, or with a multi-dimensional function characteristic such as a quadratic function.

As an aspect of the present invention, the air supply means repeats an air supply cycle which gradually increases the amount of air supply during the time after the increase of the amount of air supplied per unit time is started until it is decreased.

According to the abovementioned configuration, massaging action which cyclically repeats degrees of pressing strength such as rubbing and/or pounding can be performed, and the area to be treated can be pressed while varying the condition of the pressing strength with each of these cycles, and therefore a massage feeling that approximates the feeling obtained by the actions of rubbing and/or pounding through human hands can be obtained.

As another aspect of the present invention, the air supply and exhaust device includes an air pump for supplying air to the airbag; and a valve arranged between the air pump and the airbag; and the air supply and exhaust device performs repetition of the air supply cycle while the valve remains closed.

According to the abovementioned configuration, the strength condition of the pressing against a treatment area (the rate of increase of the pressing force) can be varied with each of the plurality of air supply cycles of this type, and because the pressing force can be increased in a stepwise manner with each repetition of the plurality of air supply cycles, a sufficient pressing force that approximates the motion of human hands but which is difficult to achieve with human hands can be exhibited, and further improvements in the massage feeling can be achieved.

What is claimed is:

1. An air massage device comprising an airbag which is inflated by a supply of air and presses against treatment regions of a human body, and an air supply and exhaust device for supplying air to and exhausting air from the airbag;

wherein the air supply and exhaust device is provided with an air supply means to supply air to the airbag such that an amount of air supplied per unit time to the airbag gradually increases, wherein the air supply means comprises an air supply speed adjustment means, wherein the air supply speed adjustment means configured to repeat a plurality of air supply cycles, wherein at least one air supply cycle of said plurality of air supply cycles comprises a first period of time when the amount of air supplied per unit time increases to a first predetermined percentage level of a maximum air supply amount by said air supply means and a second period of time when the amount of air supplied per unit time decreases to a second predetermined percentage level of said maximum air supply amount from said first predetermined percentage level.

2. The air massage device according to claim 1, wherein the air supply means is configured such that the amount of air supplied per unit time continuously increases to said first predetermined percentage level.

3. The air massage device according to claim 1, wherein the air supply means repeats said at least one air supply cycle which gradually increases an amount of air supply during a time after the increase of the amount of air supplied per unit time is started until the amount of air supplied per unit time is decreased.

4. The air massage device according to claim 3, wherein the air supply and exhaust device comprises: an air pump for supplying air to the airbag; and a valve arranged between the air pump and the airbag;

and the air supply and exhaust device performs repetition of the at least one air supply cycle while the valve remains closed.

5. The air massage device according to claim 1, wherein the first predetermined percentage level of said maximum air supply amount by said air supply means is 75%.

6. The air massage device according to claim 1, wherein the second predetermined percentage level of said maximum air supply amount by said air supply means is 50%.

* * * * *